US006382960B1

(12) United States Patent
Frigiere et al.

(10) Patent No.: US 6,382,960 B1
(45) Date of Patent: May 7, 2002

(54) CHILD RESISTANT LIGHTER

(75) Inventors: Rene D. Frigiere, Allaire; Michel J. M. Doucet, Bain sur Ouste, both of (FR); Enrique Nollas Amoros, Reus (ES); Paul H. Adams, Monroe, CT (US)

(73) Assignee: B I C Corporation, Milford, CT (US)

( * ) Notice: Subject to any disclaimer, the term of this patent is extended or adjusted under 35 U.S.C. 154(b) by 0 days.

(21) Appl. No.: 09/172,609

(22) Filed: Oct. 15, 1998

(51) Int. Cl.[7] ..... F23Q 2/28
(52) U.S. Cl. ..... 431/153; 431/255
(58) Field of Search ..... 431/153, 255, 431/276, 277

(56) References Cited

U.S. PATENT DOCUMENTS

| | | | |
|---|---|---|---|
| 3,734,680 A | | 5/1973 | Maruyama |
| 3,891,381 A | | 6/1975 | Moriya |
| 3,898,031 A | | 8/1975 | Rusakowicz |
| 4,457,697 A | | 7/1984 | Kitabayashi |
| 4,758,152 A | | 7/1988 | Kordecki |
| 4,784,601 A | | 11/1988 | Nitta |
| 4,784,602 A | | 11/1988 | Nitta |
| 4,786,248 A | | 11/1988 | Nitta |
| 4,799,877 A | | 1/1989 | Bisbee |
| 4,830,603 A | | 5/1989 | Cirami |
| 4,832,596 A | | 5/1989 | Morris, Sr. |
| 4,859,172 A | | 8/1989 | Nitta |
| 4,904,180 A | | 2/1990 | Nitta |
| 5,002,482 A | | 3/1991 | Fairbanks et al. |
| 5,035,608 A | | 7/1991 | Parren |
| 5,066,220 A | | 11/1991 | Vick |
| 5,074,781 A | | 12/1991 | Fujita |
| 5,090,893 A | | 2/1992 | Floriot |
| 5,125,829 A | | 6/1992 | McDonough et al. |
| 5,145,358 A | | 9/1992 | Shike et al. |
| 5,165,885 A | | 11/1992 | Iwahori |
| 5,165,886 A | | 11/1992 | Frigiere |
| 5,186,618 A | | 2/1993 | Shike et al. |
| 5,228,849 A | | 7/1993 | Frigiere |
| 5,240,408 A | | 8/1993 | Kenjiro et al. |
| 5,262,697 A | | 11/1993 | Meury |
| 5,288,226 A | * | 2/1994 | Khemarangsan ..... 431/153 |
| 5,295,819 A | | 3/1994 | López et al. |
| 5,334,011 A | | 8/1994 | Frigiére |
| 5,348,467 A | | 9/1994 | Piffath et al. |
| 5,368,473 A | | 11/1994 | Kenjiro et al. |
| 5,409,372 A | | 4/1995 | Nobuo |
| 5,417,571 A | | 5/1995 | Kvalseth |

(List continued on next page.)

FOREIGN PATENT DOCUMENTS

| | | |
|---|---|---|
| TW | 207783 | 6/1993 |
| WO | WO 99/46539 | 9/1999 |

OTHER PUBLICATIONS

U.S. application Ser. No. 08/583,214, filed Jan. 4, 1996 entitled "Safety Lighter with Smooth Stricker Wheel Edges" to Sher.

U.S. application Ser. No. 08/640,195, filed Jan. 4, 1995 entitled "Childproof Piezoelectric Lighter with Sliding Mechanism" to Sher.

Digital Photos of AIM Lighter (4 sheets), purchased in Aug. of 1999.

www.polycity.com, "Child Resistant Lighters", S9 Push–down Safety Lock; downloaded Oct. 7, 1999.

copy of lighter sample.

*Primary Examiner*—Sara Clarke
(74) *Attorney, Agent, or Firm*—Pennie & Edmonds LLP

(57) ABSTRACT

A child resistant lighter is disclosed which includes an actuator and a latch member pivotally coupled thereto. The latch member, when in an inoperative position, is aligned with a blocking surface of the lighter body, thus, preventing inadvertent lighting of the lighter. When in an operative position, the latch member is pivoted out of alignment with the blocking surface so that the lighter can function.

48 Claims, 10 Drawing Sheets

U.S. PATENT DOCUMENTS 5,431,558 A 7/1995 McDonough et al.
5,435,719 A 7/1995 McDomough et al.
5,445,518 A 8/1995 McDonough et al.
5,456,598 A 10/1995 McDonough et al.
5,458,482 A 10/1995 Saito et al.
5,462,432 A 10/1995 Kim
5,468,144 A 11/1995 Iwahori
5,472,338 A 12/1995 Ansquer
5,487,657 A 1/1996 Fairbanks et al.
5,513,980 A 5/1996 Rasmussen et al.
5,531,591 A 7/1996 Yamazaki
5,538,417 A 7/1996 Chan
5,558,514 A 9/1996 Ansquer
5,584,682 A 12/1996 McDonough et al.
5,636,979 A 6/1997 McDonough et al.
5,642,993 A 7/1997 McDonough et al.
5,655,901 A 8/1997 Makoto
5,662,466 A 9/1997 Cheng
5,697,775 A 12/1997 Saito et al.
5,704,776 A * 1/1998 Sher ..... 431/153
5,735,294 A 4/1998 McDonough et al.
5,769,625 A 6/1998 Sher
5,788,474 A 8/1998 Chung et al.
5,788,476 A 8/1998 Sher
5,829,963 A 11/1998 Ichikawa
5,833,448 A * 11/1998 Doucet et al. ..... 431/153
5,839,892 A 11/1998 Hwang
5,885,069 A * 3/1999 Rogelet ..... 431/153

* cited by examiner

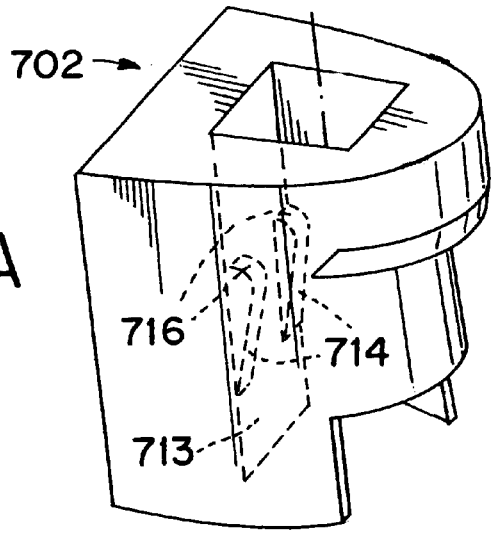
FIG. 17A
FIG. 14
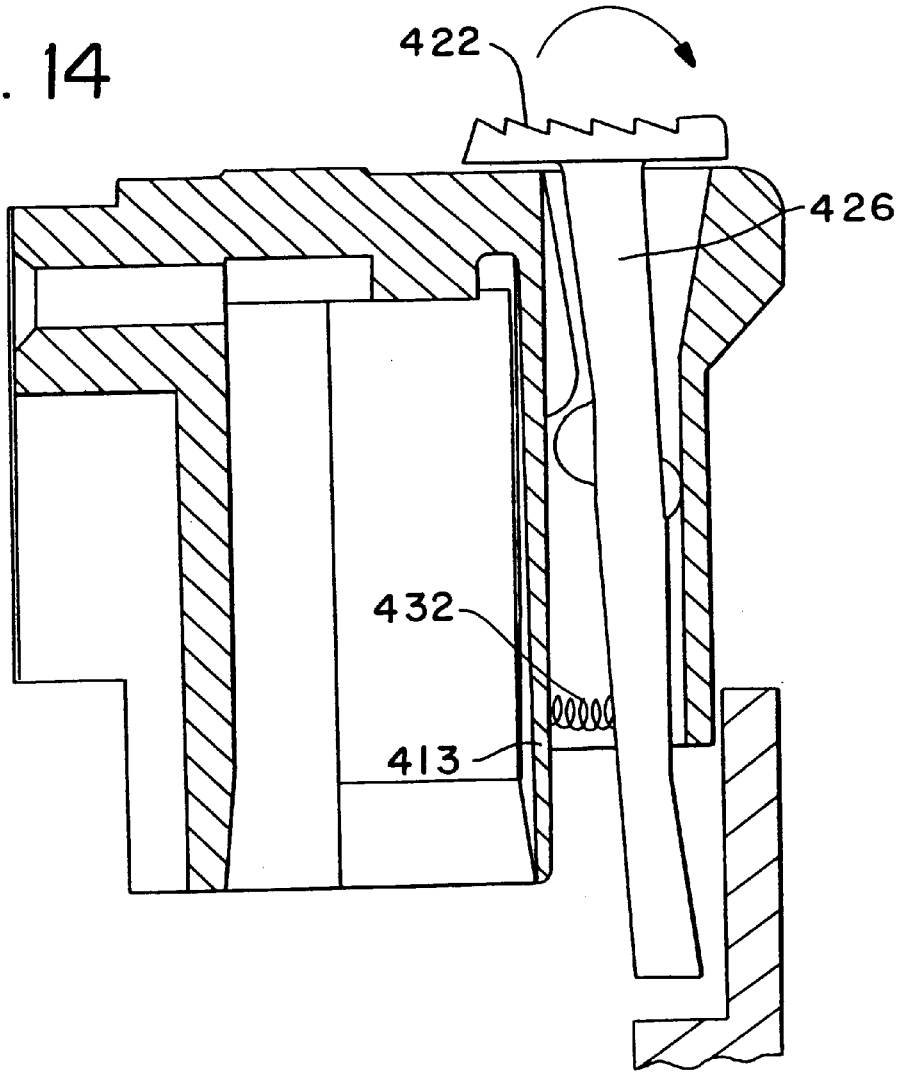

FIG. 15
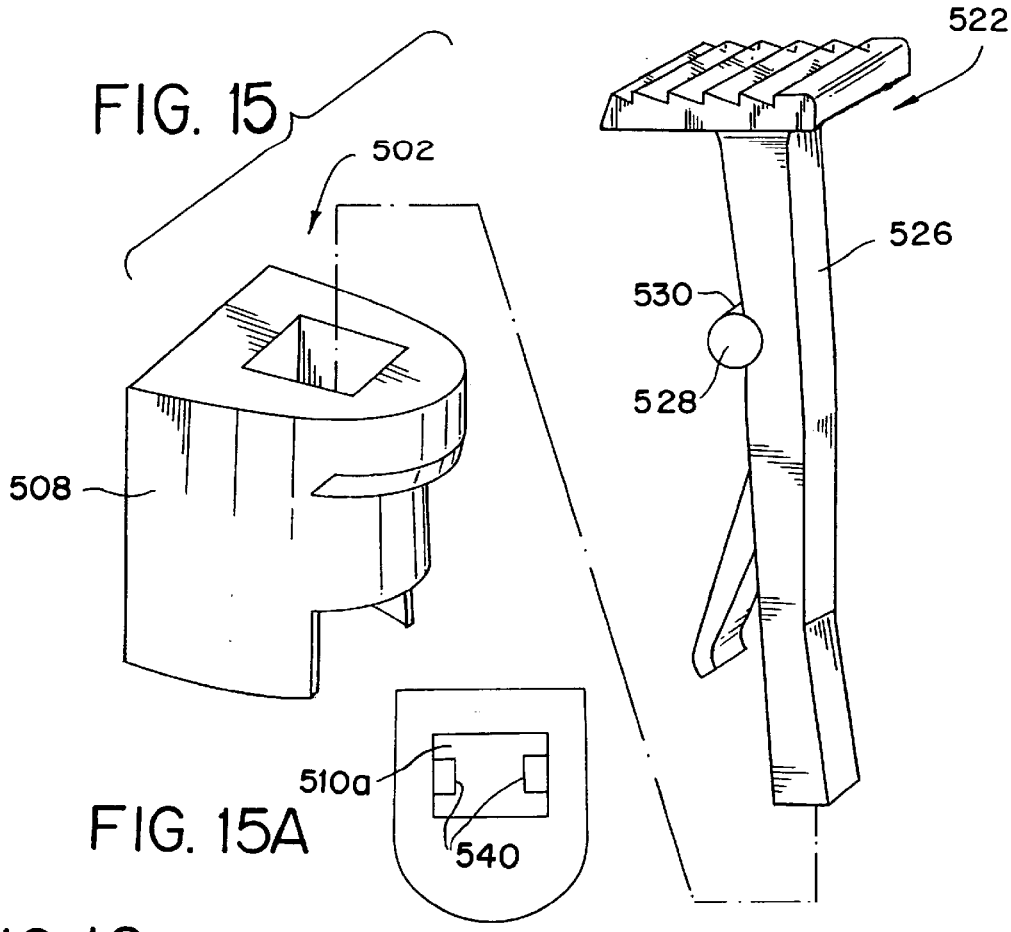
FIG. 15A
FIG. 16
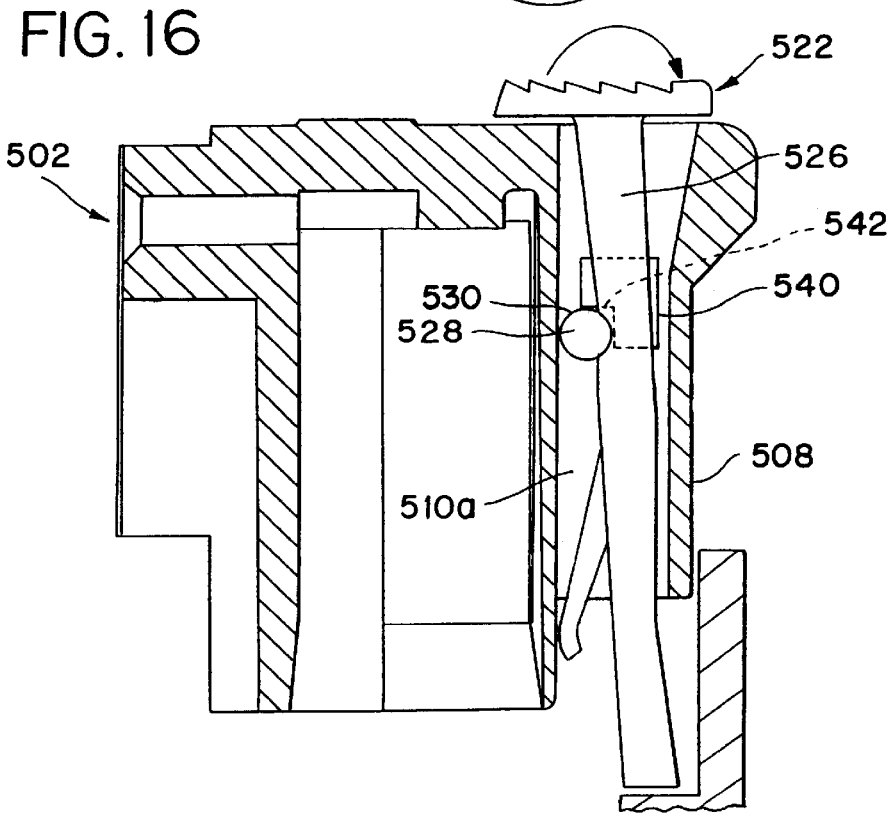

CHILD RESISTANT LIGHTER

BACKGROUND OF THE INVENTION

1. Technical Field

The present invention relates to a lighter employing an ignition system which presents increased difficulty of operation by unintended users, and more particularly, relates to a piezoelectric lighter with such a system.

2. Background Art

Disposable gas lighters are available in a variety of forms. One common element of disposable lighters is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, to release gas and produce a flame.

Another means of ignition for disposable lighters employs a piezoelectric mechanism. In this type of ignition mechanism, a piezoelectric element, such as a crystal, is struck by a plexor in order to produce an electric spark. The spark is conducted to a location near the opening of the valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism For Gas Lighters."

As with spark wheel ignition mechanisms, measures have been introduced to increase the difficulty of activation to prevent unintended activation of piezoelectric mechanisms or activation by unintended users (e.g., children 5 years old and younger). One typical method is to incorporate a separate latch member disposed under the actuator pad, which inhibits depression of the actuator pad. Examples of such mechanisms are shown in U.S. Pat. Nos. 5,435,719, 5,584,682, and 5,636,979.

There remains, however, a need in the art for improved mechanisms which increase the difficulty of operation unintentionally or by unintended users, and at the same time are user-friendly for intentional operation and intended user.

SUMMARY OF THE INVENTION

According to the present invention a lighter resistant to use by unintended users is disclosed. The lighter comprises a lighter body having a fuel compartment, a valve for supplying fuel from the fuel compartment, an actuator, an ignition mechanism, and a latch member. The actuator is mounted for movement with respect to the lighter body. The ignition mechanism includes an actuation axis, and movement of the actuator from a first position to an actuation position occurs along the actuation axis. This movement of the actuator causes the ignition mechanism to ignite the fuel. The latch member is pivotally coupled to the actuator and may extend along a rearward portion of the actuator. When the latch member is in an inoperative position, a portion of the latch member is arranged to limit movement of the actuator along the actuation axis. Upon pivoting the latch member to an operative position, the portion of the latch member is unaligned with the portion of the lighter body, which permits movement of the actuator from the first position to the actuation position to actuate the ignition mechanism to ignite the fuel.

In yet another embodiment the actuator further includes an internal wall that defines a longitudinally extending channel adapted to receive the latch member. In one embodiment, the lighter includes a configuration which prevents removal of the latch member from the actuator channel. This retention in one embodiment is provided by a pair of arms extending from the actuator into the channel. In another embodiment, the retention is provided by a projection on the actuator that contacts a projection on the latch member.

According to one embodiment of the present invention, the actuator and the latch member have cam surfaces for pivotally coupling the latch member to the actuator. According to another embodiment, the latch member and actuator are pivotally coupled by a pin. In another embodiment, the latch member and actuator cooperate to prevent the latch member from over-pivoting. In another embodiment, the lighter further includes a biasing element disposed between the latch member body portion and the actuator for biasing the latch member into the inoperative position. The biasing element is a spring integrally formed with the latch member, a coil spring separate from the latch member or a metal leaf spring coupled to the latch member.

BRIEF DESCRIPTION OF THE DRAWINGS

To facilitate the understanding of the characteristics of the invention, the following drawings have been provided wherein:

FIG. 14 is a partial, cross-section view of the of yet another embodiment of the actuator and the latch member;

FIG. 15 is an exploded, enlarged, perspective view of yet another embodiment of the actuator and the latch member;

FIG. 15A is a top view of the actuator shown in FIG. 15;

FIG. 16 is a partial, cross-section view of the actuator and the latch member shown in FIG. 15 in an assembled, inoperative position;

FIG. 17A is an enlarged perspective view of another embodiment of the actuator shown in FIG. 17.

DESCRIPTION OF THE PREFERRED EMBODIMENTS

Figure 1:
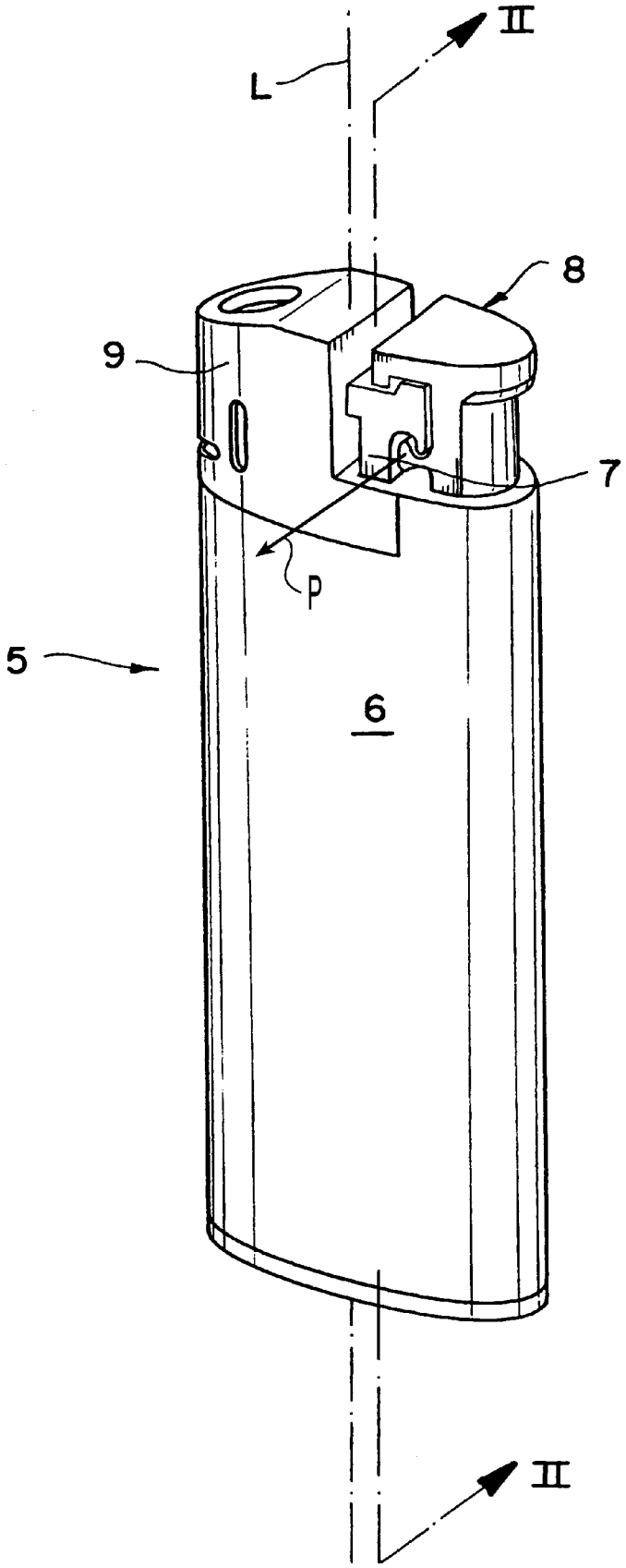
FIG. 1 is a perspective view of a lighter having an actuator and a latch member formed in accordance with the principles of the present invention.

Referring to the drawings, wherein like reference numbers are used to designate like parts, and as shown in FIG. 1, a lighter 5 having an actuation inhibiting mechanism formed in accordance with the principles of the present invention is shown. Lighter 5 has a longitudinal or actuation axis L, a body portion 6, a depressible valve actuator 7, a latch member 8 and a wind shield 9. Additionally, a piezoelectric ignition mechanism 10 is provided within lighter 5, as may be seen in, for example, the cross-sectional view of FIG. 2.

Figure 2:
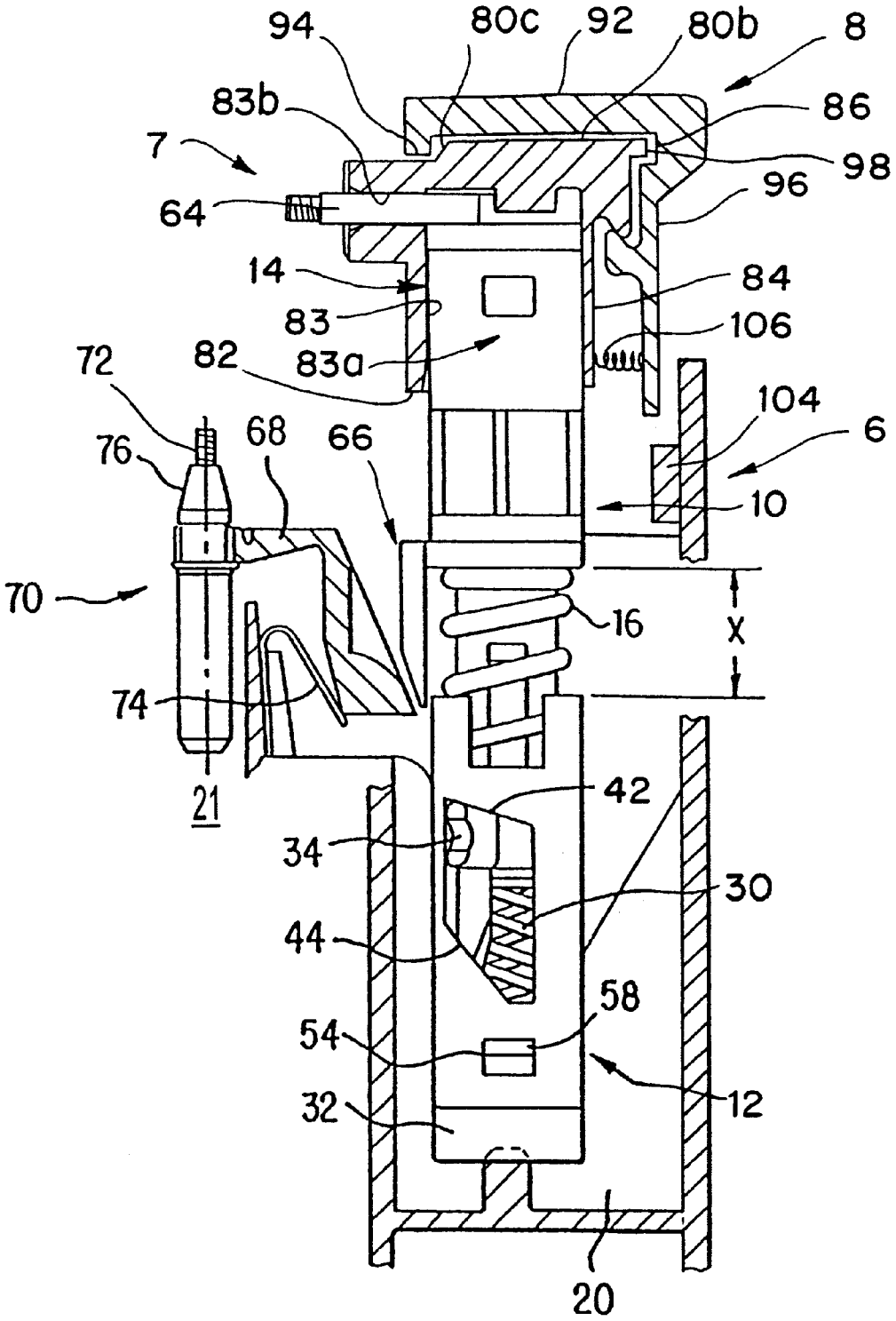
FIG. 2 is a front longitudinal view, in partial cross section, along line II—II, of the lighter of FIG. 1 showing the actuator and latch member in an inoperative position and the piezoelectric mechanism in the rest or normal configuration.

Referring now to FIG. 2, the ignition system of lighter 5 includes a piezoelectric ignition mechanism 10. However, the present invention is not limited to this type of ignition mechanism and other types of piezoelectric mechanisms and non-piezoelectric mechanisms can be used. Other recommended types of ignition mechanisms include a spark-wheel and flint or a roll and press. An example of a roll and press ignition mechanism that can be used is disclosed in U.S. Pat. No. 5,468,144 issued to Iwahori. The disclosed mechanism includes an actuator and a rotary body coupled thereto, and pressing the actuator causes the rotary body to contact a flint and create a spark.

Figure 3:
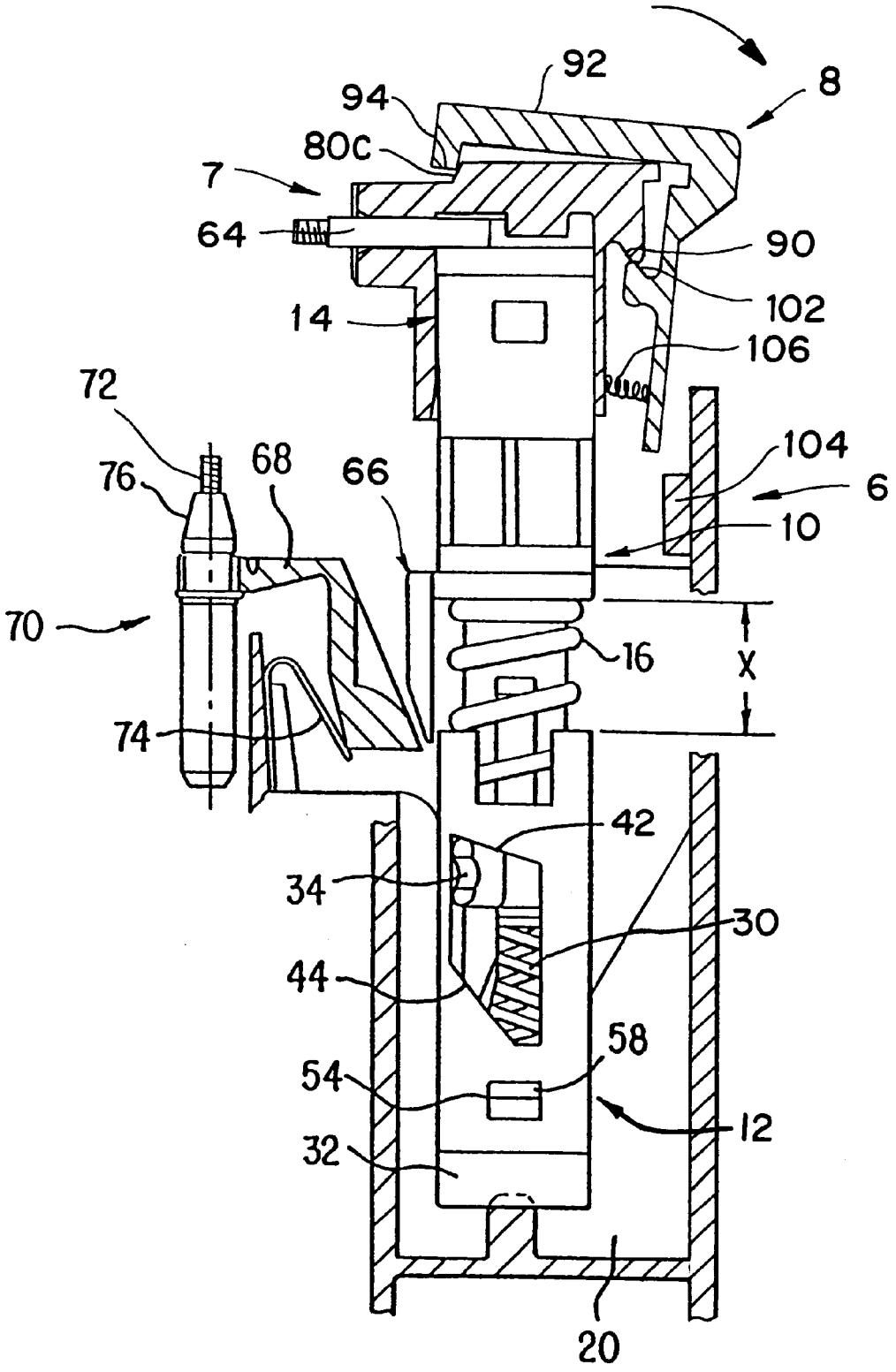
FIG. 3 is a front longitudinal view of the actuator and the latch member shown in FIG. 2 in an operative position.

Referring to FIGS. 2 and 3, further details of the piezoelectric ignition mechanism 10 of lighter 5 are depicted, and the piezoelectric ignition mechanism is shown in the rest or normal configuration. The piezoelectric mechanism comprises an outer telescope member 12, and inner telescopic member 14. Return spring 16 is positioned between the outer member 12 and the inner member 14 to maintain a separation denoted by X between the two members. Piezoelectric mechanism 10 is disposed in a chamber 20 located in the body portion 6 of the lighter, and is isolated from the fuel source or supply 21, e.g., compressed hydrocarbon gas.

Figure 4:
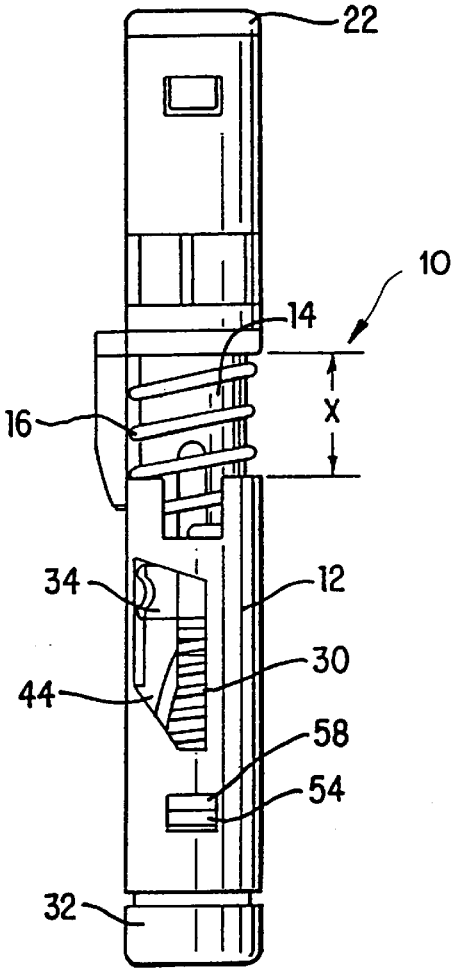
FIG. 4 is a front longitudinal view of the piezoelectric mechanism shown in FIG. 2.
Figure 5:
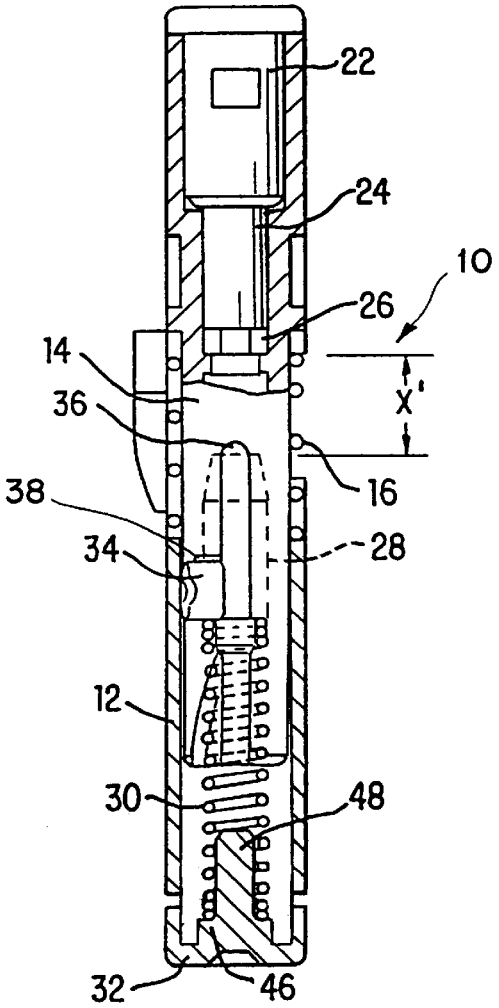
FIG. 5 is a partial cross-sectional view of the piezoelectric mechanism of FIG. 4.
Figure 8:
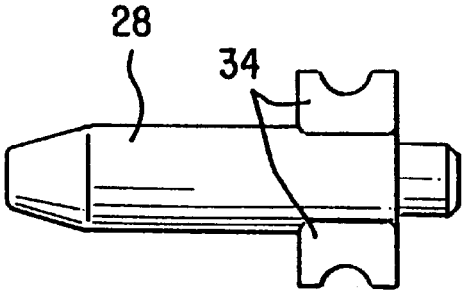
FIGS. 8 and 9 are front and side views of the plexor.
Figure 9:
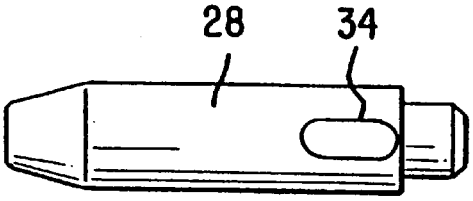

As also shown in FIGS. 4 and 5, piezoelectric mechanism 10 comprises anvil member 22, piezoelectric element 24 and impact pad 26. Plexor 28, shown in phantom, in FIG. 5 and also in FIGS. 8 and 9, is guided within inner telescopic member 14. Plexor 28 is resiliently biased toward impact pad 26 by impact spring 30, which is also disposed in inner member 14. Outer member 12 also has end member 32 affixed thereon.

Figure 6:
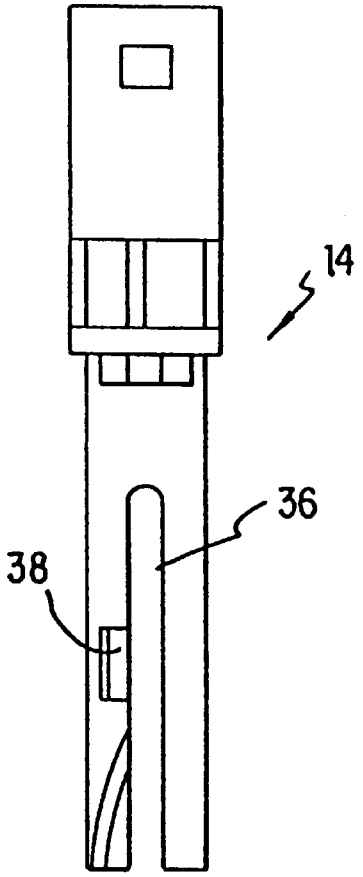
FIG. 6 is a front view of the inner telescopic member of the mechanism of FIG. 2.
Figure 7:
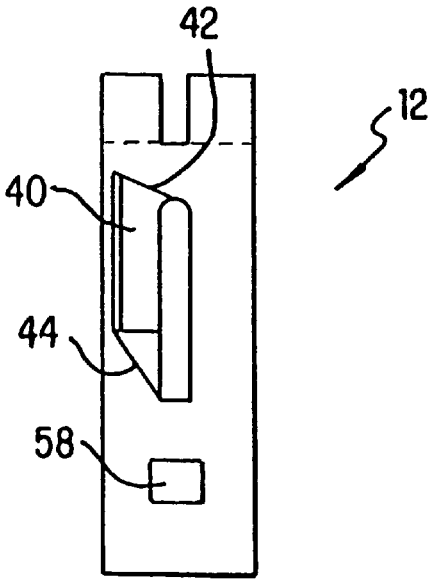
FIG. 7 is a front view of the outer telescopic member of FIG. 5.

As shown in FIGS. 6–9, plexor 28 has two lugs 34 formed on opposite sides thereof. Lugs 34 are received in longitudinal slots 36, which are defined on opposite sides of inner member 14 as shown in FIG. 6. Longitudinal slots 36 guide the displacement of plexor 28, limiting it to the longitudinal direction. Each longitudinal slot 36 has retaining notch 38. Lugs 34 are configured and dimensioned to protrude beyond slots 36 and into windows 40, which are defined on opposite sides of outer member 12 as shown in FIGS. 2 and 7. Window 40 also has an upper ramp surface 42 and lower ramp surface 44. Thus, the displacement and movement of lugs 34 is controlled by slots 36, notches 38 and ramp surfaces 42 and 44.

In the normal or rest configuration shown in FIGS. 4–6, lugs 34 of plexor 28 are being held in notches 38 of longitudinal slots 36 on the inner member 14, and plexor 28 is retained at a predetermined distance X' away from impact pad 26. Plexor 28 is being resiliently pushed toward impact pad 26 by impact spring 30 as shown in FIGS. 4 and 5. The bottom end of impact spring 30 abuts against ledge 46 of end member 32. The bottom end of impact spring 30 is also received by boss 48 to assist in the positioning of impact spring 30.

Referring to FIG. 4, end member 32 also has hooks 54 disposed on opposite sides thereof. Hooks 54 engage with openings 58 on outer telescopic member 12 to retain end member 32 in outer member 12.

Referring to FIGS. 2 and 5, piezoelectric member 24 is one element in an electrical circuit comprising first electrode 64, anvil 22, piezoelectric member 24, impact pad 26, cam member 66, valve actuator 68, valve system 70 and second electrode 72. After the plexor 28 strikes impact pad 26, which transfers the impact energy to the piezoelectric element 24, an electrical potential difference is created across piezoelectric element 24. The potential difference across piezoelectric element 24 is conducted through this circuit, and creates substantially the same potential difference between first electrode 64 and second electrode 72. This potential difference is sufficient to discharge a spark across the air gap between the two electrodes. In other words, the two electrodes act similar to a capacitor with an air dielectric disposed there between. Any electrically conductive material may be utilized to make the components of this circuit. A person of ordinary skill in the art may select suitable materials for the various components in this circuit.

When the actuator 7 is depressed, as discussed below, to create the spark, cam member 66 is also depressed, and acts on valve actuator 68. Valve actuator 68 is pivoted such that when cam member 66 pushes one end of actuator downward, the other end is moved upward thereby lifting valve system 70 to release fuel gas. The released gas is then ignited by the spark discharged between electrodes 64 and 72.

Valve system 70 controls the release of fuel from the fuel supply 21. In a preferred embodiment as shown generally in FIG. 2, the fuel supply is compressed hydrocarbon gas and valve system 70 is a normally open valve, forced closed by the pressure of a spring member 74. In this embodiment, valve actuator 68 acts on valve system 70 to lift valve stem 76 upward to release the compressed hydrocarbon.

Figure 10:
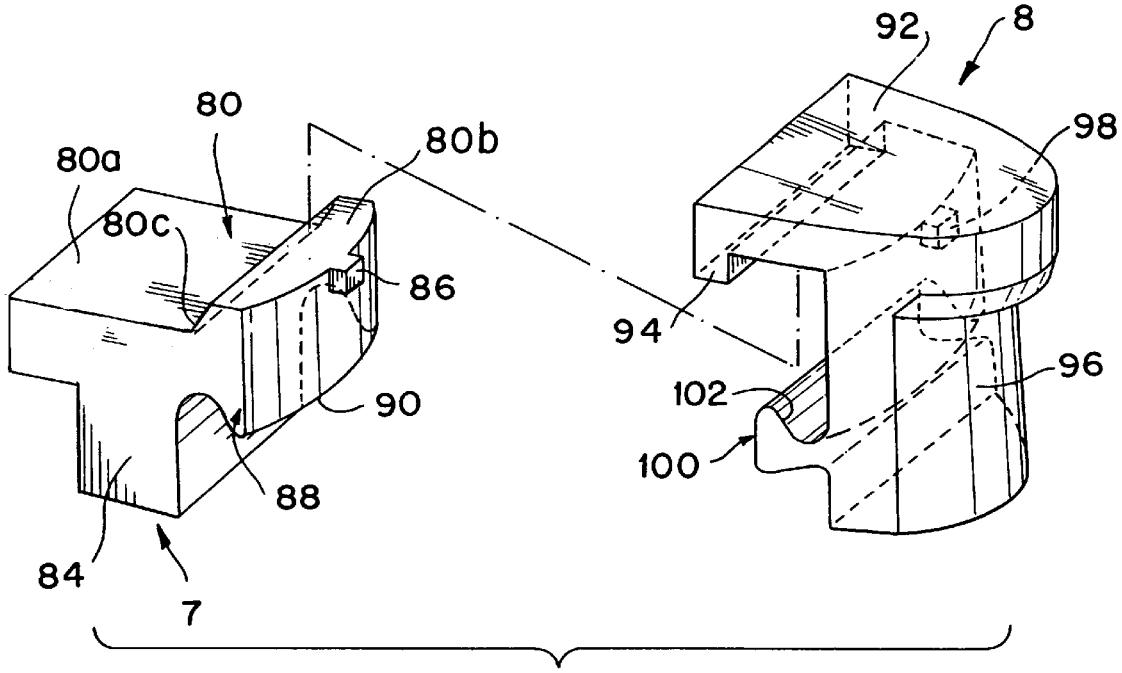
FIG. 10 is an exploded, enlarged, perspective view of the actuator and latch member shown in FIG. 2.

Referring to FIGS. 2 and 10, the actuator 7 comprises a top wall with a top surface 80, a spaced lower surface 82, and a side wall 84 joining these surfaces. The top surface 80 is divided into a lower surface portion 80*a* and an elevated, upper surface portion 80*b* separated by an upstanding ledge member 80*c*.

The lower surface 82 of the actuator defines an opening to a chamber 83. The chamber 83 is defined by the top wall bottom surface, and side wall, and includes a partially, longitudinally extending cavity 83*a* and a transversely extending portion 83*b*. The cavity 83*a* receives the piezoelectric mechanism 10. The transversely extending portion 83*b* receives the first electrode 64.

The side wall 84 includes a projection 86 and a overhang 88. The projection 86 extends rearwardly from the back side of the side wall 84 adjacent the top surface 80. The overhang 88 extends rearwardly and downwardly from the back side of the side wall 84 along the side wall. The overhang 88 has a bottom cam surface 90.

The latch member 8 comprises a finger actuation portion 92, a rim member 94, and a body portion 96. The finger actuation portion 92 when assembled overlies the upper portion 80*b* of the top surface of the actuator 7, as shown in FIG. 2. The rim member 94 extends downwardly from the front of the finger actuation portion 92 of the latch member. The body portion 96 extends downwardly from the back of the finger actuation portion 92 of the latch member.

Referring to FIG. 10, the front surface of the body portion 96 defines a channel 98 (shown in phantom) adjacent the finger portion 92. The channel 98 is defined so that when assembled, the projection 86 on the actuator 7 is received within the channel 98 to limit the side-to-side movement of the latch member 8 with respect to the actuator 7.

The body portion 96 further includes a pivot member 100 extending from the front surface thereof below the channel 98. The pivot member 100 includes an upper cam surface 102 that cooperates with the bottom cam surface 90 of the actuator 7 to allow the latch member 8 to pivot with respect to the actuator 7. The geometry of the overhang 88 is such that the latch member 8 is pivotally coupled to the actuator. Pivotally coupled as used in the specification and appended claims means that the latch member is coupled to the actuator in a manner that allows the latch member to pivot with respect to the actuator.

As shown in FIGS. 1, 2 and 3, the lighter body 6 further includes a blocking surface 104 which extends inwardly from the back wall of the lighter body. When the latch member 8 in an inoperative position, the lower surface of the body portion 96 engages the blocking surface 104 of the lighter body. Thus, depression of the latch member 8 and the actuator 7 along the actuation axis L is arrested, and the interaction between the latch member, actuator, and lighter body prevents inadvertent lighting of the lighter.

The lighter 5 may further include a biasing element 106, such as a coil spring, disposed between the back side wall 84 of the actuator 7 and the body portion 96 of the latch member 8. The coil spring biases the latch member 8 into the inoperative position.

In order to generate a spark, the latch member 8 must be in an operative position (as shown in FIG. 3). A user pulls rearwardly on the latch member finger portion 92 as illustrated by the arrow in FIG. 3, and causes the upper cam surface 102 to cooperate with the bottom cam surface 90 and the latch member 8 pivots rearwardly about a pivot axis P (as shown in FIG. 1). The pivot axis is perpendicular to the axis L. Although the latch member and actuator are pivotally coupled, cooperation between the rim member 94 and the ledge 80*c* prevents over-pivoting of the latch member, as best shown in FIG. 3. As the latch member 8 pivots the coil spring 106 is compressed. Also, the body portion 96 of the latch member 8 moves out of alignment with the blocking surface 104. Thus, the lighter is in an operative position.

In the operative position, a user may depress the latch member 8 causing the latch member 8 and actuator 7 to move downwardly along the actuation axis. This movement depresses or pushes inner telescopic member 14 downward and into outer telescopic member 12 thereby compressing return spring 16 and impact spring 30. As the inner telescopic member is being pushed downward, lugs 34 of the plexor 28 slide downward until each reaches the top of ramp surface 44.

Referring to FIG. 5, the continuing depression of inner telescopic member 14 compresses impact spring 30 and pushes lugs 34 of plexor 28 downward along ramp surface 44 until lugs 34 are released from notches 38. After lugs 34 are released, plexor 28 is immediately driven by compressed impact spring 30 toward impact pad 26 and strikes impact pad 26 to transfer the energy stored in the impact spring 30 to piezoelectric element 24, to thereby excite piezoelectric element 24 to create an electrical potential across same.

Turning to FIGS. 2 and 6, after the impact pad 26 has been struck by plexor 28, the user simply releases the actuator 7, thereby allowing the compressed return spring 16 to once again separate the inner and outer telescopic members from each other, until ramp surfaces 42 align with notches 38. Due to the generally upward slope of ramp surfaces 42, lugs 34 of plexor 28 are pushed by impact spring 30 along ramp surfaces 42 until lugs 34 are deposited into notches 38, such that lugs 34 and plexor 28 are retained in notches 38. This is the rest or normal configuration depicted in FIGS. 2, 4 and 5.

Once the latch member 8 and the actuator 7 are released, the coil spring 106 biases the latch member 8 back into alignment with the blocking surface 104 so that the lighter is again in the inoperative position.

Figure 11:
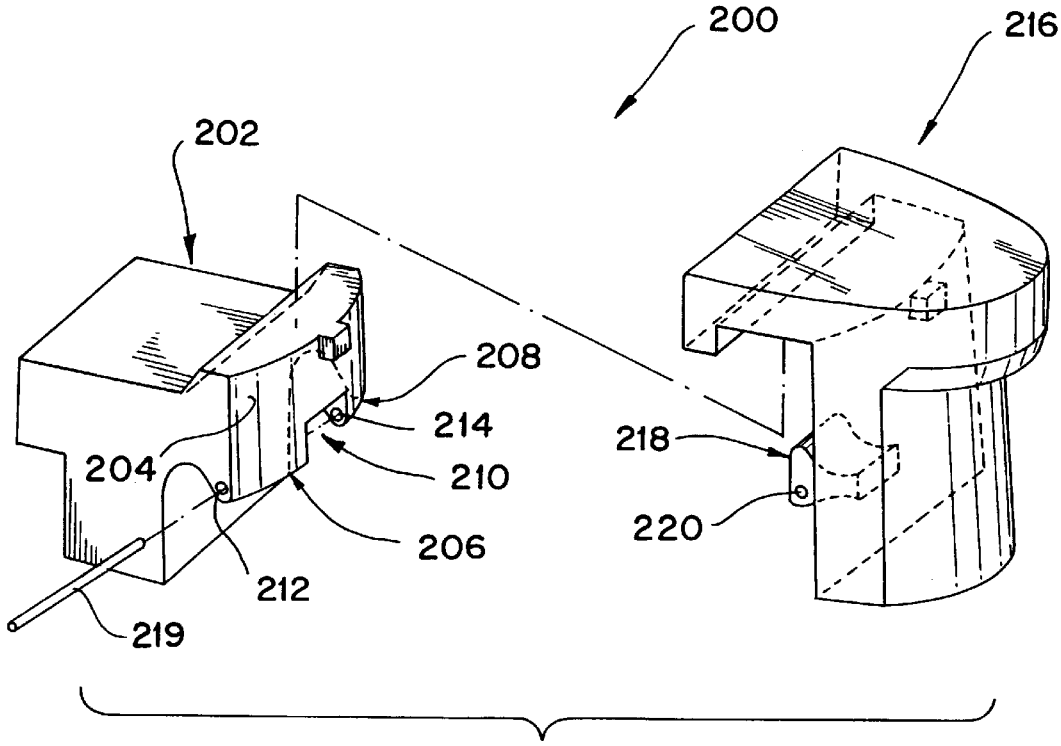
FIG. 11 is an exploded, enlarged, perspective view of another embodiment of the actuator and the latch member.

FIG. 11 illustrates another embodiment of the actuation inhibiting mechanism 200. Back side wall 204 of the actuator 202 includes two spaced overhangs 206 and 208 which are separated by a slot 210. Each overhang 206 and 208 defines aligned laterally extending bores 212 and 214, respectively.

The latch member 216 includes a pivot member 218 dimensioned to fit within the slot 210. The pivot member 218 also defines a laterally extending bore 220. Once assembled, the bores 212 and 214 of the overhangs 206 and 208 and the bore 220 of the pivot member 218 are aligned and a pin 219 is inserted there through. Thus, the latch member 216 and the actuator 202 are pivotally coupled. As discussed above, the lighter is in an inoperative position, when a portion of the latch member interferes with a portion of the lighter body. The pivotal coupling of the latch member 216 to the actuator 202 via the bores and pin allows the latch member to be moved between the inoperative and the operative states.

Figure 12:
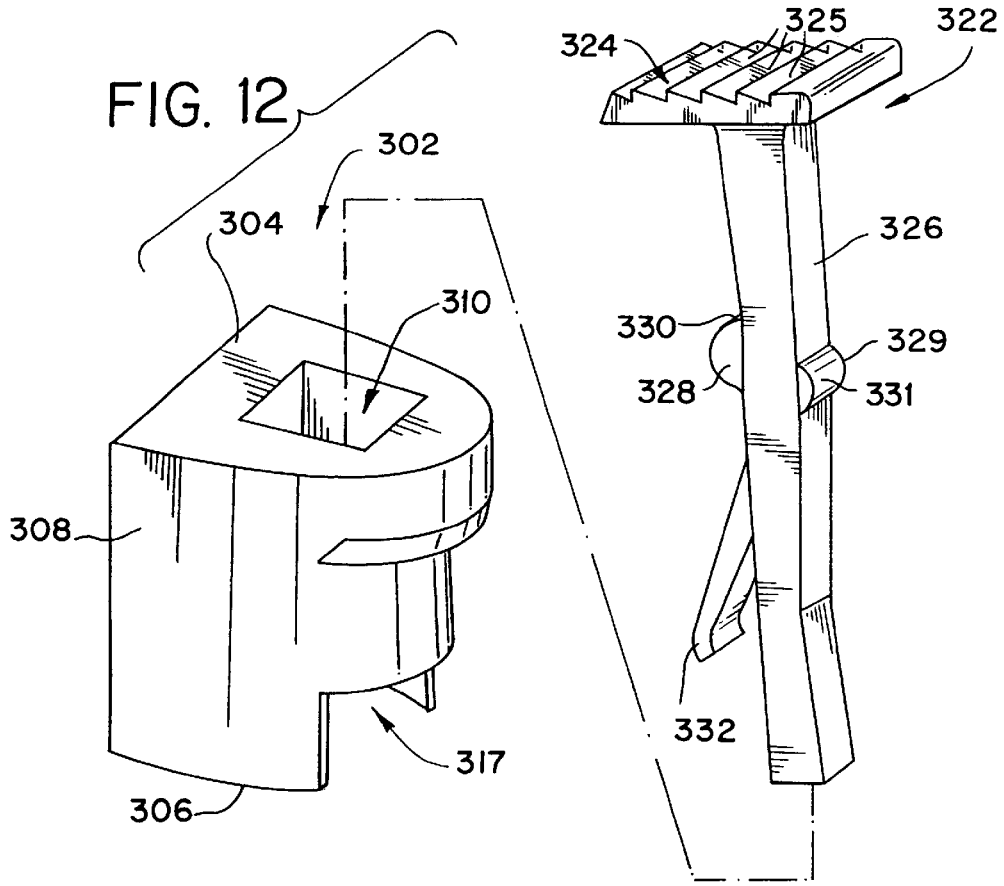
FIG. 12 is an exploded, enlarged, perspective view of yet another embodiment of the actuator and the latch member.
Figure 13:
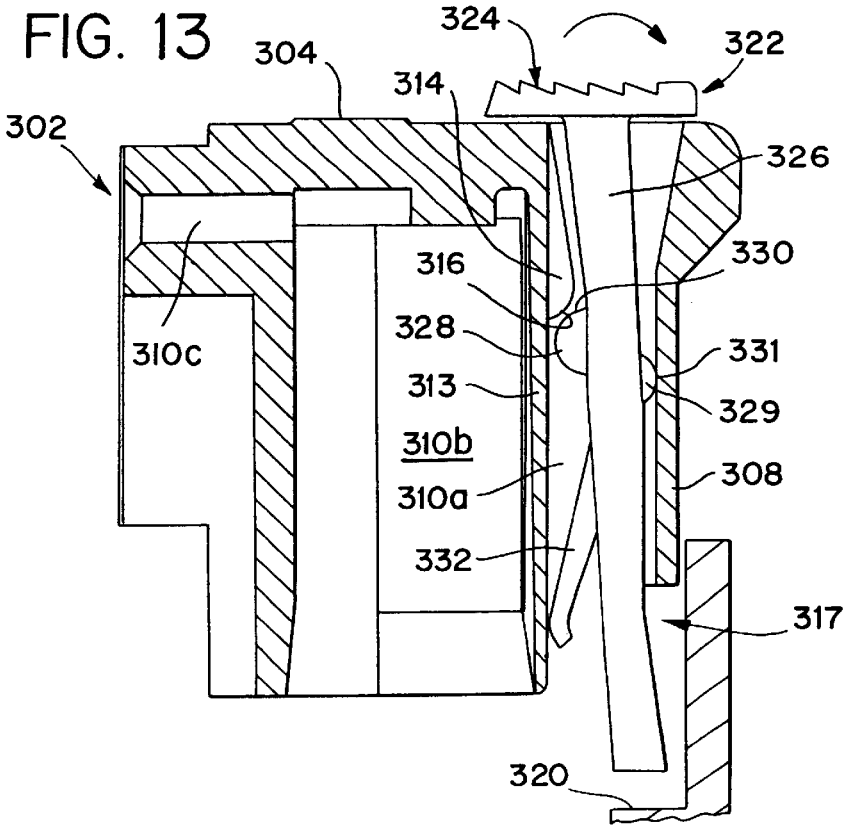
FIG. 13 is a partial, cross-section view of the actuator and the latch member shown in FIG. 12 in an assembled, inoperative position.

In FIGS. 12 and 13 the actuator 302 includes a top wall with a top surface 304, a bottom surface 306, and a side wall 308 joining the top wall,bottom surface, and the side wall form a chamber 310 within the actuator.

As best shown in FIG. 13, the actuator 302 further includes an internal wall 313 that divides the chamber 310 into a longitudinally extending channel 310*a* and a cavity 310*b*. The channel 310*a* extends through the top surface 304 of the actuator. The cavity 310*b* receives the piezoelectric mechanism 10 (as shown in FIG. 2). The cavity 310*b* has a transversely extending portion 310*c* which receives the first electrode 64 (as shown in FIG. 2).

The internal wall 313 has at least one overhang 314 that extends downwardly into the channel 310*a*. Each overhang 314 includes a bottom cam surface 316. The back side wall 308 further includes a slot 317.

The latch member 322 includes a finger actuation portion 324 and a body portion 326 extending downwardly therefrom. The finger actuation portion 324 includes a top surface shaped and configured to provide increased friction with the user's finger to facilitate movement thereof by the user. Illustratively, this may be accomplished by forming one or more ridges 325 on the top surface of the finger actuation portion.

The body portion 326 includes a first or front pivot member 328 and a second or rear pivot member 329. The front pivot member 328 extends from the front surface of the body portion 326, and the rear pivot member 329 extends from the rear surface of the body portion 326. The pivot member 328 includes an upper cam surface 330 that cooperates with the bottom cam surface 316 of the actuator overhang. The pivot member 329 includes a rear cam surface 331 that cooperates with the inner surface of the actuator back side wall 308. The body portion 326 of the latch member 322 further includes an integrally formed biasing element 332 that extends from the front surface downwardly.

In an assembled position, as shown in FIG. 13, the body portion 326 of the latch member 322 extends through the channel 310*a* so that the bottom cam surface 316 and the upper cam surfaces 330 cooperate to pivotally couple the actuator 302 and the latch member 322. In an inoperative position, similarly to that discussed above, the blocking surface 320 of the lighter body prevents the latch member 322 and the actuator 302 from being moved downwardly. The biasing element 332 contacts the internal wall 313 and biases the latch member 322 into the inoperative position.

By pivoting the finger portion 324 of the latch member 322 rearwardly, as designated by the arrow, the bottom portion of the latch member 322 pivots out of alignment with the blocking surface 320. This is due to the engagement of the cam surfaces 316 and 330 and the cam surface 331 with the wall 308. The upper portion of the channel 310*a* is flared to allow the upper portion of the latch member 322 to pivot rearwardly. Once this movement occurs, the lighter is in an operative position, and the actuator can be depressed. Interaction between the latch member body portion 326 and the actuator top surface 304 surrounding the channel 310*a* prevents over-pivoting of the latch member.

Referring to FIG. 14, the latch member 422 shown is similar to the latch member 322 of FIGS. 12 and 13, however, the latch member 422 has a body portion 426 that uses a separate coil spring biasing element 432. The spring 432 cooperates with the actuator internal wall 413, as discussed above, to bias the latch member 422 in the inoperative position. In another embodiment, the biasing element can be a metal leaf spring coupled to the body portion of the latch member.

Referring to FIGS. 15 and 15A, the latch member 522 and the actuator 502 shown are similar to the latch member 322 and actuator 302 of FIGS. 12 and 13; however, the latch member 522 has a body portion 526 that includes a transversely extending cylindrical portion 528 extending from the front surface of the body portion 526. The cylindrical portion 528 has an upper surface 530. The actuator 502 includes the side wall 508 and the channel 510*a*. The side wall 508 is configured to include a pair of arms 540 that extend inwardly into the channel 510*a*. Each arm 540 has a cutout 542 in the lower surface.

Turning to FIGS. 15A and 16, when the latch member 522 is installed into the actuator 502 the cylindrical portion 528 is disposed below the arms 540 so that the upper surface 530 contacts the cutouts 542. This pivotally couples the actuator 502 to the latch member 522 and prevents the latch member 522 from being easily removed.

Figure 17:
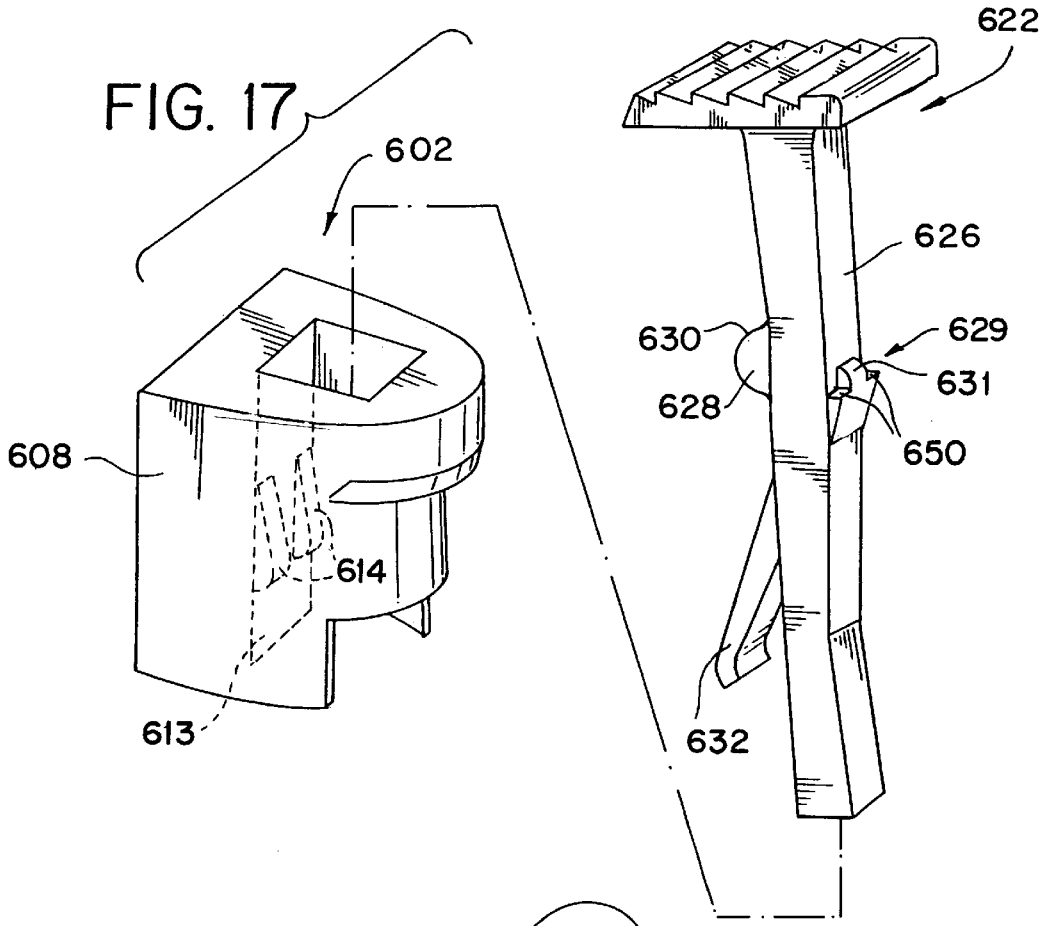
FIG. 17 is an exploded, enlarged, perspective view of another embodiment of the actuator and the latch member.
Figure 18:
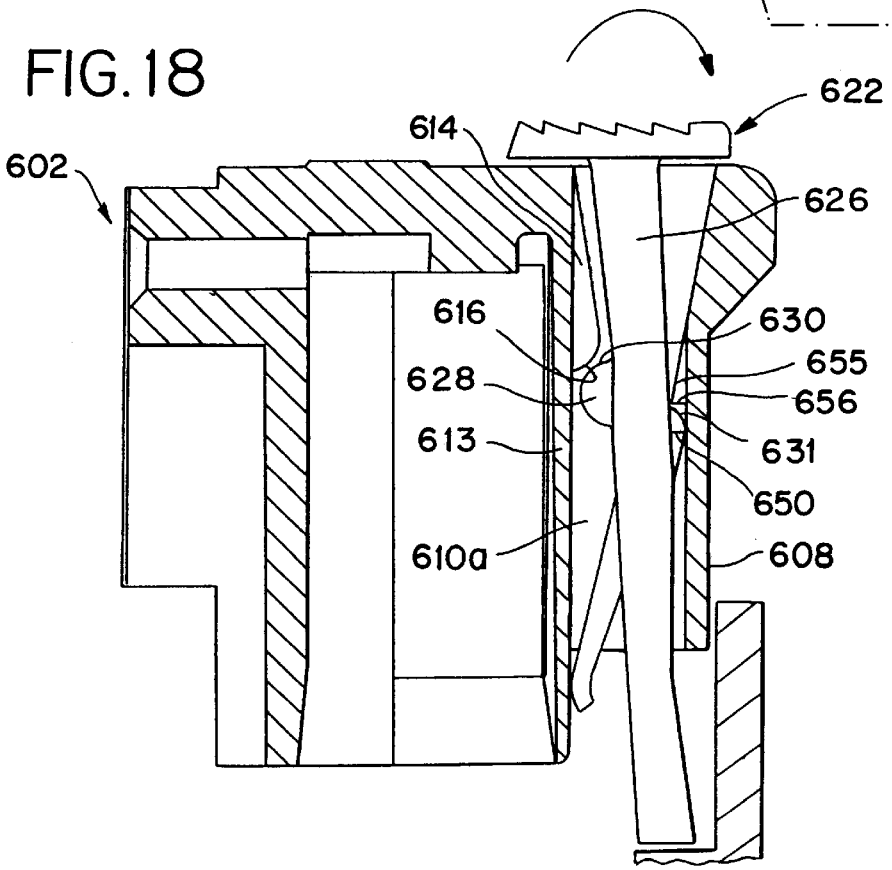
FIG. 18 is a partial, cross-section view of the actuator and the latch member shown in FIG. 17 in an assembled, inoperative position.

Referring to FIGS. 17 and 18, the latch member 622 and the actuator 602 shown are similar to the latch member 322 and actuator 302 of FIGS. 12 and 13. The latch member 622 has a body portion 626 that includes a first or front pivot member 628 and a second or rear pivot member 629. The front pivot member 628 extends from the front surface of the body portion 626, and the rear pivot member 629 extends from the rear surface of the body portion 626. The front pivot member 628 includes an upper cam surface 630. In this embodiment, the pivot member 628 extends across the entire body portion 626; however, in another embodiment two spaced pivot members can be used.

The rear pivot member 629 includes a central, arcuate rear cam surface 631 that increases in width to a maximum then tapers longitudinally along the body portion 626. The pivot member 629 further includes two flat platforms 650 that extend from the body portion 626 on either side of the rear cam surface 631.

The actuator 602 includes the internal wall 613 that defines the channel 610*a*. The internal wall 613 has two spaced overhangs 614 defining a gap there between. Each overhang 614 extends downwardly into the channel 610*a*, and includes a bottom cam surface 616. The gap between the overhangs 614 allow the spring 632 to pass there between during insertion of the latch member 622 into the actuator 602 without over-stressing the spring.

The back side wall 608 further includes two projections 655 that extend into the channel 610*a*. Each projection 655 includes a flat bottom surface 656. The projections 655 are spaced apart so that when the latch member 622 is installed in the actuator 602 the flat bottom surfaces 656 are aligned with the flat platforms 650 on the latch member. Thus, preventing the easy removal of the latch member 622 from the actuator 602. The cam surface 631 extends between the platforms 655 so that the cam surface 631 can contact the internal wall 608. Once installed, the cam surface 630 cooperates with the bottom cam surface 616 of the actuator overhang 614. The cooperation between the cam surfaces 630 and 616 and the cam surface 631 and the internal wall 608 allows the latch member 602 to pivot with respect to the actuator 602, as discussed above.

In another embodiment, the overhangs of the actuator, and the latch member's front pivot member can include bores. A pin can be disposed there through, as discussed earlier with respect to FIG. 11, so that the pin and bores pivotally couple the latch member to the actuator.

Referring to FIG. 17A, the actuator 702 shown is similar to the actuator 602 of FIGS. 17 and 18, however, the actuator includes two overhangs 714 extending from the internal wall 713. The overhangs 714 include cam surfaces 716. The overhangs 714 are oriented so that upon installation of the latch member 622 (as shown in FIG. 17) into the actuator 702, the overhangs 714 are below the pivot member 628 of the latch member 622.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A lighter resistant to use by unintended users, said lighter comprising:

a lighter body having a fuel compartment;

a valve for supplying fuel from said fuel compartment;

an actuator mounted for movement with respect to said lighter body;

an ignition mechanism for igniting the fuel, the ignition mechanism coupled to the actuator such that movement of said actuator causes said ignition mechanism to ignite said fuel; and a latch member being pivotally and non-bendably coupled to said actuator, wherein when said latch member is in the inoperative position a body portion of said latch member is aligned with a portion of said lighter body so that movement of said actuator is limited and upon pivoting said latch member to an operative position, said portion of said latch member is unaligned with said portion of said lighter body which permits movement of said actuator to an actuation position to actuate said ignition mechanism to ignite said fuel.

2. The lighter as in claim 1, wherein said actuator further includes a top surface, a spaced bottom surface, and at least one side wall extending between said surfaces, and said top surface includes a lower surface portion and an elevated, upper surface portion separated by an upstanding ledge member, wherein said ledge member prevents said latch member from over-pivoting.

3. The lighter as in claim 2, wherein said latch member further includes a finger actuation portion which overlies said top surface of said actuator, a rim member extending downwardly from one side of said finger actuation portion, and a body portion extending downwardly from said other side of said finger actuation portion, wherein cooperation between said ledge member and said rim member prevents said latch member from over-pivoting.

4. The lighter as in claim 3, wherein the actuator further includes an overhang extending from said back of said side wall, said overhang having a first cam surface.

5. The lighter as in claim 4, wherein said latch member further includes a pivot member extending from said front surface of said body portion of said latch member, said pivot member having a second cam surface pivotally coupling with said first cam surface.

6. The lighter as in claim 4, further including a biasing element disposed between said latch member body portion and said actuator for biasing said latch member into said inoperative position.

7. The lighter as in claim 6, wherein said biasing element is a spring integrally formed with said latch member.

8. The lighter as in claim 6, wherein said biasing element is a coil spring separate from said latch member.

9. The lighter as in claim 6, wherein said biasing element is a metal leaf spring coupled to said latch member.

10. The lighter as in claim 3, wherein the actuator further includes two spaced overhangs extending from said back of said side wall, said overhangs defining a slot there between, each overhang further defining a transversely extending bore there through, and the latch member further includes a pivot member extending from said front surface of said body portion of said latch member, said pivot member defining a transversely extending bore there through, such that a pin is insertable through said bores of said overhang and said pivot member to pivotally couple said latch member to said actuator.

11. The lighter as in claim 1, wherein the actuator further includes a protruding member extending from the back side wall of the actuator, and the latch member defines a channel for receiving the protruding member, whereupon side-to-side movement of the latch member is limited.

12. The lighter of claim 1, wherein the latch member further includes a finger actuation portion and a body portion extending from the finger actuation portion, said finger actuation portion being disposed above a top surface of the actuator.

13. The lighter of claim 1, wherein the latch member further includes two free ends.

14. The lighter of claim 1, wherein the latch member is separate from the actuator.

15. The lighter of claim 1, wherein the ignition mechanism is a piezoelectric mechanism.

16. The lighter of claim 1, wherein the actuator further includes a back side and the latch member is pivotally coupled to the back side of the actuator.

17. The lighter of claim 1, wherein the latch member includes only a single downwardly extending body portion.

18. The lighter of claim 1, wherein the lighter body further includes a back wall and the portion of the lighter body limiting movement of the actuator is adjacent the back wall.

19. The lighter of claim 1, further including a biasing clement wherein upon the user releasing the latch member, the biasing element moves the latch member into the inoperative position.

20. The lighter of claim 1, further including a biasing element wherein upon an intended user releasing the latch member, the biasing element moves the latch member into the inoperative position.

21. The lighter of claim 1, wherein the latch member is held in the operative position by an intended user's finger.

22. The lighter of claim 1, wherein the ignition mechanism has an actuation axis, and the movement of the actuator is along the actuation axis.

23. The lighter as in claim 22, wherein said latch member pivots about a pivot axis that is perpendicular to the actuation axis.

24. A lighter resistant to use by unintended users, said lighter comprising:

a lighter body having a fuel compartment;

a valve for supplying fuel from said fuel compartment;

an actuator mounted for movement with respect to said lighter body, said actuator including an internal wall defining a longitudinally extending channel adapted to receive a latch member;

an ignition mechanism having an actuation axis, movement of said actuator from a first position along said actuation axis to an actuation position along said actuation axis causing said ignition mechanism to ignite said fuel; and said latch member being pivotally coupled to said actuator wherein when said latch member is in said inoperative position a portion of said latch member is aligned with a portion of said lighter body so that movement along said actuation axis of said actuator is limited and upon pivoting said latch member to an operative position said portion of said latch member is unaligned with said portion of said lighter body which permits movement of said actuator from said first position to said actuation position to actuate said ignition mechanism to ignite said fuel.

25. The lighter as in claim 24, wherein said actuator further includes a top surface, a spaced bottom surface, at least one side wall extending between said surfaces, and said internal wall further includes at least one overhang extending therefrom, said overhang having a first cam surface.

26. The lighter as in claim 25, wherein said latch member further includes a finger actuation portion for overlying said top surface of said actuator and a body portion extending from said finger actuation portion, said body portion including a first pivot member extending therefrom, said first pivot member having a second cam surface pivotally coupling with said first cam surface of said actuator.

27. The lighter as in claim 26, wherein said actuator side wall further includes a pair of arms that extend inwardly into said channel, and each arm includes a cutout in said lower surface.

28. The lighter as in claim 27, wherein said first pivot member is cylindrical and upon being installed in said actuator is disposed within said cutouts.

29. The lighter as in claim 26, wherein said first pivot member extends from said front surface of said body portion, and said latch member further includes a second pivot member extending from said rear surface of said body portion, said second pivot member having a rear cam surface that cooperates with said side wall of said actuator.

30. The lighter as in claim 29, wherein said internal wall further includes two spaced overhangs extending therefrom, and said back side wall of said actuator further includes two spaced projections that extend into said channel and each includes a flat bottom surface.

31. The lighter as in claim 30, wherein said second pivot member includes a central arcuate rear cam surface that tapers longitudinally along said body portion, and said second pivot member further includes two spaced flat platforms, such that upon installation of said latch into said channel said flat platforms are aligned with said flat bottom surfaces.

32. The lighter as in claim 24, further including a spring biasing element disposed between the latch member and the actuator for biasing the latch member in the inoperative position.

33. The lighter as in claim 32, wherein said biasing element is a spring integrally formed with said latch member.

34. The lighter as in claim 32, wherein said biasing element is a coil spring separate from the latch member.

35. The lighter as in claim 32, wherein said biasing element is a metal leaf spring coupled to said latch member.

36. A lighter resistant to use by unintended users, said lighter comprising:

a lighter body having a fuel compartment;

a valve for supplying fuel from said fuel compartment;

an actuator mounted for movement with respect to said lighter body, said actuator defining a channel;

an ignition mechanism having an actuation axis, movement of said actuator from a first position along said actuation axis to an actuation position along said actuation axis causing said ignition mechanism to ignite said fuel; and a latch member being pivotally mounted with respect to the actuator, said latch member further including an external, finger actuation portion and a body portion dependent from the finger actuation portion, said body portion including a blocking portion being receivable within the channel of the actuator, wherein when said latch member is in the inoperative position the blocking portion of the body portion prevents movement of said actuator along said actuation axis, and upon pivoting said latch member to an operative position said blocking portion of said body portion permits movement of said actuator from said first position to said actuation position to actuate said ignition mechanism to ignite said fuel.

37. The lighter as in claim 36, further including a biasing element in contact with the latch member for biasing said latch member into said inoperative position.

38. The lighter as in claim 37, wherein said biasing element is a coil spring separate from said latch member.

39. The lighter as in claim 36, wherein said body portion further including a cylindrical pivot member extending therefrom perpendicular to the actuation axis.

40. A lighter comprising:

a housing having a fuel supply and a blocking surface;

a valve for supplying fuel from said fuel supply;

an ignition mechanism for igniting the fuel;

an actuator mounted for movement with respect to said housing; and a latch member being pivotally coupled to the actuator and includes a finger actuation portion disposed above the actuator, and the actuator being disposed between the housing and the finger actuation portion, wherein the latch member is configured and adapted to be pivotally moved from an inoperative position where the latch member is aligned with the blocking surface to an operative position where the latch member becomes unaligned with the blocking surface which permits movement of said actuator to an actuation position.

41. The lighter of claim 40, wherein the ignition mechanism is coupled to the actuator, movement of the actuator causing the ignition mechanism to ignite the fuel.

42. The lighter of claim 40, further including a biasing element operatively associated with the latch member, the biasing element biases and moves the latch member into the inoperative position whenever the latch member is released by a user.

43. The lighter of claim 42, wherein the ignition mechanism further includes a longitudinal axis, and the movement of the actuator is along the longitudinal axis.

44. The lighter of claim 40, wherein the latch member is seperated from the actuator.

45. A lighter comprising:

a housing having a fuel supply and a blocking surface;

a valve for supplying fuel from said fuel supply;

an actuator mounted for movement with respect to said housing;

an ignition mechanism for igniting the fuel;

a latch member only coupled to the actuator by a pivotal connection and having two free ends detached from the actuator; and a biasing element operatively associated with the latch member, wherein the latch member is configured and adapted to be pivotally moved from an inoperative position where the latch member is aligned with the blocking surface to an operative position where the latch member becomes unaligned with the blocking surface which permits movement of said actuator to an actuation position, and the biasing element biases and moves the latch member into the inoperative position whenever the latch member is released by a user.

46. The lighter of claim 45, wherein the ignition mechanism further includes a longitudinal axis, and the movement of the actuator is along the longitudinal axis.

47. A lighter resistant to use by unintended users, said lighter comprising:

a lighter body having a fuel compartment;

a valve for supplying fuel from said fuel compartment;

an actuator mounted for movement with respect to said lighter body;

an ignition mechanism for igniting the fuel, the ignition mechanism operatively associated with the actuator movement of said actuator causing said ignition mechanism to ignite said fuel; and a latch member being pivotally and non-bendably coupled to said actuator, wherein when said latch member is in the inoperative position a portion of said latch member is aligned with a portion of said lighter body so that movement of said actuator is limited and upon pivoting said latch member to an operative position, said portion of said latch member is unaligned with said portion of said lighter body which permits movement of said actuator to an actuation position to actuate said ignition mechanism to ignite said fuel, and the latch member is always freely movable between the inoperative position and the operative position.

48. A lighter resistant to use by unintended users, said lighter comprising:

a lighter body having a fuel compartment;

a valve for supplying fuel from said fuel compartment;

an actuator mounted for movement with respect to said lighter body;

an ignition mechanism for igniting the fuel, the ignition mechanism operatively associated with the actuator movement of said actuator causing said ignition mechanism to ignite said fuel; and a latch member being pivotally coupled to said actuator, and the latch member including a finger actuation portion;

wherein when said latch member is in the inoperative position a portion of said latch member is aligned with a portion of said lighter body so that movement of said actuator is limited and upon pivoting said latch member to an operative position, said portion of said latch member is unaligned with said portion of said lighter body which permits movement of said actuator to an actuation position to actuate said ignition mechanism to ignite said fuel, and moving the finger actuation portion away from the valve moves the latch member between the inoperative position and the operative position.

* * * * *